US005218162A

United States Patent [19]

Bender-Zanoni

[11] Patent Number: 5,218,162

[45] Date of Patent: Jun. 8, 1993

[54] DOUBLE-ENDED AMMUNITION HANDLING SYSTEM FOR RAPID-FIRE GUNS

[75] Inventor: Joseph F. Bender-Zanoni, Grand Isle, Vt.

[73] Assignee: General Electric Co., Burlington, Vt.

[21] Appl. No.: 823,931

[22] Filed: Jan. 21, 1992

[51] Int. Cl.[5] ..... F41A 9/31

[52] U.S. Cl. ..... 89/33.02; 89/33.16; 89/34

[58] Field of Search ..... 89/33.02, 33.04, 33.1, 89/33.17, 33.4, 34, 33.14, 33.16, 9, 45

[56] References Cited

U.S. PATENT DOCUMENTS

| | | | |
|---|---|---|---|
| 2,910,917 | 11/1959 | Herlach et al. | 89/33 |
| 2,935,914 | 5/1960 | Darsie et al. | 89/33.02 |
| 2,993,415 | 7/1961 | Panicci et al. | 89/33.02 |
| 3,720,301 | 3/1973 | Garland et al. | 198/32 |
| 3,747,469 | 7/1973 | Ashley et al. | 89/34 |
| 4,299,158 | 11/1981 | Aloi et al. | 89/137 |
| 4,572,351 | 2/1986 | Golden | 198/412 |
| 4,573,395 | 3/1986 | Stoner | 89/33.16 |
| 4,589,325 | 5/1986 | Muller et al. | 89/33.02 |
| 4,742,756 | 5/1989 | Mannhart | 89/33.02 |
| 4,833,966 | 5/1989 | Maher et al. | 89/33.16 |
| 4,882,971 | 11/1989 | Yanusko et al. | 89/33.02 |
| 4,982,650 | 1/1991 | Bender-Zanoni et al. | 89/34 |

FOREIGN PATENT DOCUMENTS

| | | | |
|---|---|---|---|
| 582564 | 11/1946 | United Kingdom | 89/33.14 |

*Primary Examiner*—Stephen M. Johnson
*Attorney, Agent, or Firm*—Stephen A. Young

[57] ABSTRACT

A double-ended ammunition handling system for feeding a rapid-fire gun comprises a magazine including a plurality of coextensive channels having entry ends presented to a magazine entrance unit and exit ends presented to a magazine exit unit. Live ammunition rounds are scooped from the channel exit ends in repeating succession by the magazine exit unit and merged into a continuous stream which is fed to the gun. The magazine entrance unit accepts a stream of spent shell casings from the gun, which are inserted in the channel entry ends in corresponding repeating succession to push the live ammunition rounds in the channels toward the magazine exit ends. The magazine entrance and exit units utilize either complementary rotary or linear scoop assemblies, and the magazine channels may be implemented as replaceable ammunition clips.

18 Claims, 4 Drawing Sheets

DOUBLE-ENDED AMMUNITION HANDLING SYSTEM FOR RAPID-FIRE GUNS

The present invention relates to ammunition handling systems and particularly to a system for feeding linkless rounds of ammunition from a storage magazine to a rapid-fire gun and receiving spent shell casings in return.

BACKGROUND OF THE INVENTION

In a typical ammunition handling system serving a rapid-fire gun, the individual rounds of ammunition are accommodated on separate carriers which are serially interconnected to form a conveyor. This conveyor is trained throughout the interior of a magazine in a manner to maximize storage density. The conveyor interfaces with a transfer mechanism operating to pick rounds from the moving conveyor and provide a stream of rounds which is routed out of a magazine exit port for delivery to the gun, typically via chuting. In many system applications, spent shell casing, rather than being ejected from the system, are fed back from the gun and deposited on the previously emptied conveyor carriers for magazine storage.

It is seen that, in systems of this type, the magazine conveyor must run an extremely high velocity to keep up with the firing rate of the gun, which can exceed 60000 shots per minute. This requires a large and powerful conveyor drive train, particularly when conveying large caliber ammunition.

To reduce the velocity at which the ammunition rounds must be circulated through the magazine without sacrificing firing rate, a multi-tier or multi-bay magazine approach has been utilized. Each bay or tier is equipped with a separate ammunition conveyor whose rounds are merged with the rounds of the other conveyors into a single, gun-feeding stream. Each conveyor can then run at a fraction of the firing rate velocity. Typically however, this tiered or multi-bay approach has been single-ended, in that spent shell casings are not fed back into the magazine.

In view of the extremely high firing rates of Gatling guns, it is necessary that the magazine have a large storage capacity. This means that the magazine conveyors must be very lengthy. All of the numerous guides and sprockets necessary to train a long conveyor along a high packing density tortuous path, typically a serpentine path, throughout the magazine interior adds complexity and expense.

To dramatically reduce conveyor length without sacrificing magazine storage capacity, it has been proposed to store live ammunition rounds in a plurality of parallel channels with their exit ends arrayed in successive relation proximate a stripping conveyor. This relatively short conveyor then picks off the leading ammunition round presented at the exit end of each channel in repeating succession to make up a stream of rounds. A pusher mechanism acts against the trailing round in each channel to advance the parallel rows of ammunition rounds toward the channel exit ends. Ammunition handling systems of this type are disclosed in commonly assigned Garland et al. U.S. Pat. No. 3,720,301 and Ashley et al. U.S. Pat. No. 3,747,469. However, these systems do not accept spent shell casings back from the rapid-fire gun.

SUMMARY OF THE INVENTION

It is accordingly an objective of the present invention to provide an ammunition handling system having the requisite high magazine storage capacity for serving a rapid-fire gun by delivering a stream of live ammunition rounds to the gun and accepting a stream of spent shell casings back from the gun. Bulk storage of the ammunition rounds in the magazine is achieved without resort to an internal magazine conveyor or conveyors, and live round feeding propagation through the magazine is motivated by the returning spent shell casings.

To these ends, the double-ended ammunition handling system of the present invention includes a magazine exit unit for delivering a stream of live ammunition rounds to a rapid-fire gun and a magazine entrance unit for accepting a stream of spent shell casings back from the gun. A storage magazine, situated between the entrance and exit units, includes a plurality of coextensive channels in which live ammunition rounds and spent shell casings are held in linkless, peripheral surface-engaging relation. The entry ends of the channels are arranged in successive, side-by-side relation adjacent the entrance unit, and the exit ends of the channels are likewise arrayed adjacent the exit unit. A stripping conveyor, included in the exit unit, picks off a live ammunition from the exit end of each channel in repeating succession to make up the stream of live ammunition rounds delivered to the gun. A distribution conveyor, included in the entrance unit, distributes the incoming stream of spent shell casings into the entry ends of the channels. The stripping and distribution conveyors are synchronized such that, as the former picks a live ammunition round from the exit end of a particular channel, the latter inserts a spent shell casing into the entry end of the same channel. Thus, the channels are all times completely filled with live rounds and spent shell casings, and it is the insertions of the spent shell casings into the entry ends that advances the rows of live ammunition rounds along the channels into successive presentations at the exit ends thereof.

In accordance with one embodiment of the invention, the channels are in the form of modular ammunition clips which, when filled with spent shell casings, are removed and replaced with clips filled with live ammunition rounds. Reloading of the magazine is thus effected in a simple and expeditious manner.

The invention accordingly comprises the features of construction, combinations of elements, and arrangements of parts, all as detailed hereinafter, and the scope of the invention will be indicated in the claims.

BRIEF DESCRIPTION OF THE DRAWINGS

For a full understanding of the nature and objects of the present invention, reference may be had to the following Detailed Description taken in connection with the accompanying drawings, in which.

Corresponding reference numerals refer to like parts throughout the several views of the drawings.

DETAILED DESCRIPTION

Figure 1:
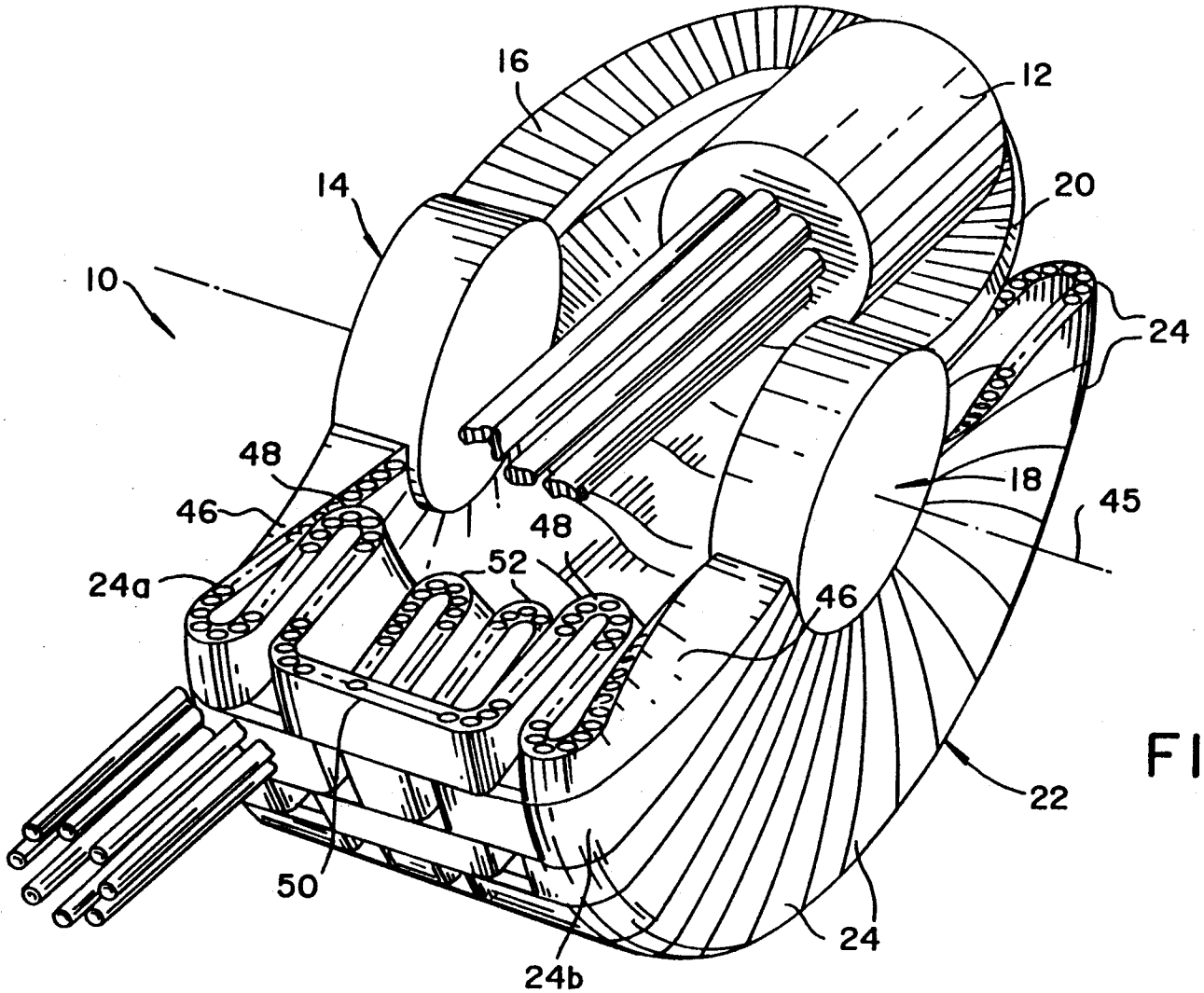
FIG. 1, is a perspective view of an ammunition handling system constructed in accordance with one embodiment of the invention suited for application to turret-mounted rapid-fire gun systems.

In the embodiment seen in FIG. 1, the ammunition handling system of the present invention, generally indicated at 10, is illustrated in its application to a turret-mounted Gatling gun 12. The system includes a magazine exit unit, generally indicated at 14, for delivering a stream of live ammunition rounds of the case telescoped type to the gun through chuting 16 and a magazine entrance unit, generally indicated at 18, for accepting a stream of spent shell casings from the gun through chuting 20. The entrance and exit units serve a magazine, generally indicated at 22, which is comprised of a plurality of ammunition-containing channels 24 of equal length with their exit ends in open communication with magazine exit unit 14 and their entry ends in open communication with magazine entrance unit 18. The channels 24 are in the form of ducts of rectangular cross section conforming to the right circular cylinder shape of the live ammunition rounds and spent shell casings. As will be seen in FIG. 2, magazine exit unit 14 picks up individual live ammunition rounds from the exit ends of the channels 24 in repeating succession to make up the stream of live ammunition rounds delivered to the gun as the magazine entrance unit 18 distributes the incoming stream of spent shell casing from the gun into the entry ends of the channels in synchronized repeating succession. The serial propagation of live ammunition rounds through the channels toward their exit ends is motivated by the coincident insertions of spent shell casings into the channel entry ends. That is, since the live and spent rounds in each channel are in peripheral surface engagement, each round pushes against the round immediately ahead of it in response to the forced insertions of spent shell casings into the entry ends of the channels.

Figures 2, 3:
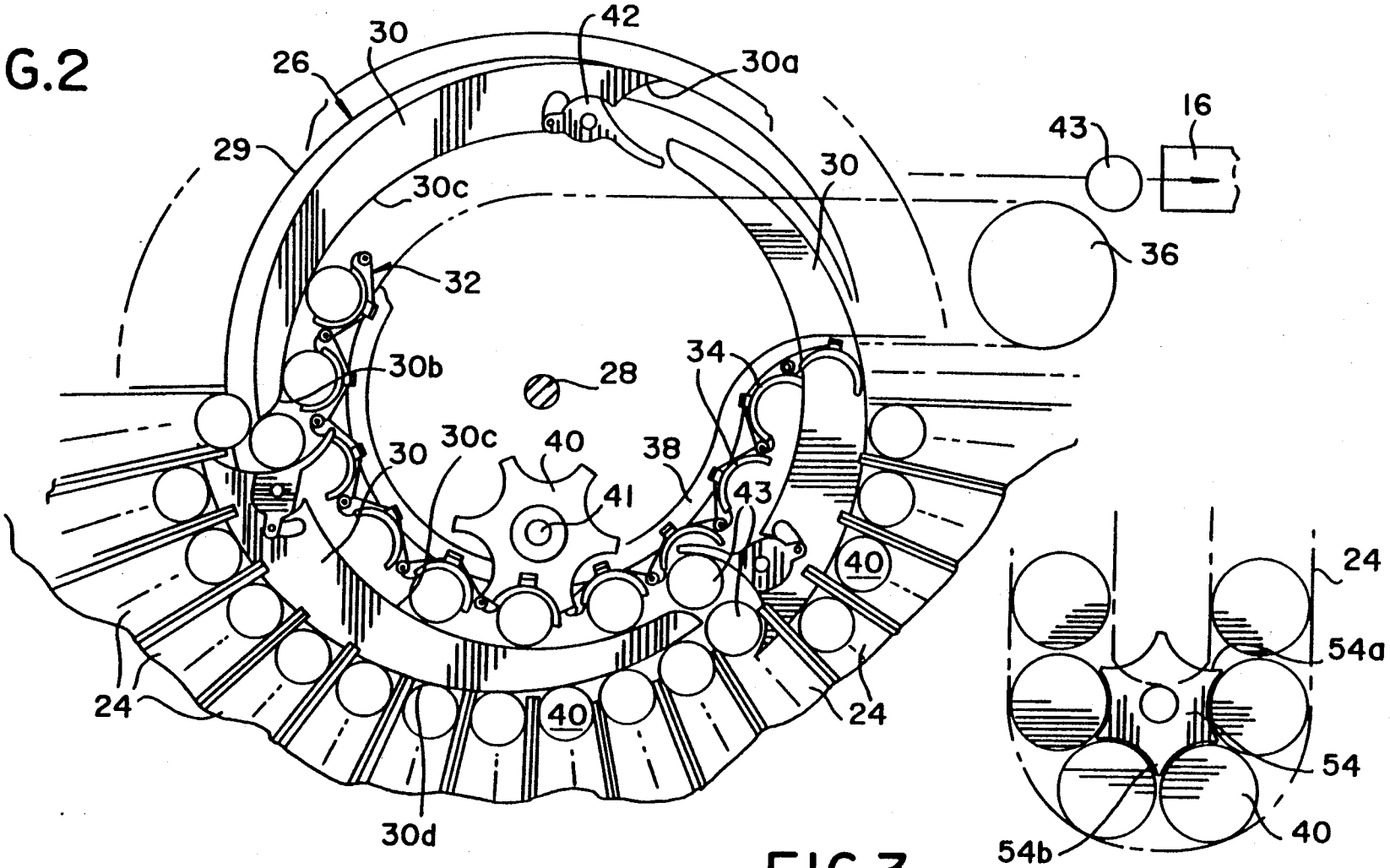
FIG. 2 is a front view of one of the magazine units utilized in the ammunition handling system of FIG. 1.
FIG. 3 is a plan view of a star sprocket utilized in the ammunition handling system of FIG. 1 to facilitate negotiation of ammunition rounds through 180° turns in the ammunition paths through the magazine.
Figure 5:
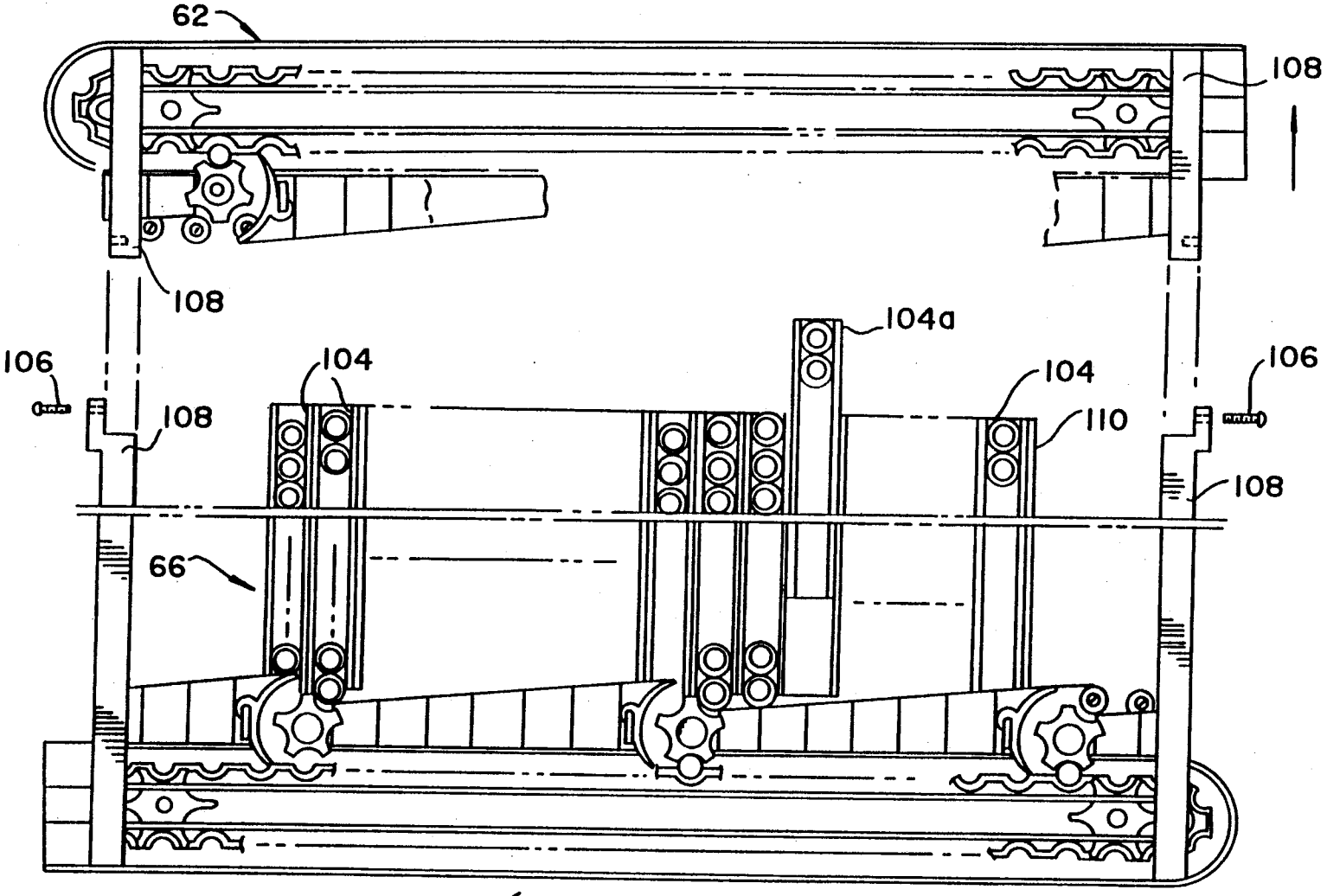
FIG. 5 is a front view illustrating the adaption of removable ammunition clips to the ammunition handling system of FIG. 4 to expedite magazine reloading.

Turning to FIG. 2, magazine exit unit 14 is illustrated as being basically constructed in the manner disclosed in FIG. 5 of the above-cited Garland et al. patent, the disclosure of which is specifically incorporated herein by reference. Thus, the magazine exit unit includes an onloading mechanism in the form of a rotary scoop assembly, generally indicated at 26, which is driven off a shaft 28. The scoop assembly includes a wheel 29, which carries three laterally spaced pairs of 120° sector cams 30 arranged end-to-end in full circle relation around shaft 28. An endless ammunition conveyor 32, comprised of pivotally interconnected carriers 34, is trained about a laterally spaced pair of turnaround sprockets 36 and is guided along an arcuate path around the interior of the scoop wheel radially inward of the sector cams 30 by a laterally spaced pair of tracks 38. A pair of sprockets 40, journalled on a stationary shaft 41, are driven off the rotation of the scoop wheel in the manner disclosed in the Garland et al. patent to propel conveyor 32 along its endless path in a clockwise direction at a requisite linear velocity greater than the clockwise angular velocity of the rotary scoop assembly.

The exit ends of channels 24, as seen in FIG. 2, are arrayed in side-by-side relation along an arc proximate a sector of the scoop wheel periphery. The leading ends **30*a* of sector cams 30 are scoop-shaped and are radially positioned to scoop out the leading live ammunition rounds 43 presented at the exit ends of each of the channels as the sector cams sweep by during clockwise rotation of the scoop assembly. The trailing ends 30*b* of the sector cams cooperate with the sector cam leading ends 30*a* and pivotal cam extensions 42 in guiding the scooped live ammunition rounds into consecutive carriers 34 of the ammunition conveyor 32. The radially inner arcuate surfaces 30*c* of the sector cams maintain live ammunition rounds in the conveyor carriers, while the spiralled radially outer sector cam surfaces 30*d*** serve to control the positions of the live ammunition rounds at the channel exits in preparation to being scooped out.

It is thus seen that the scoop wheel assembly and conveyor function as a stripping conveyor to strip or scoop live ammunition rounds from the exit ends of the channels in repeating successions. The carriers of the conveyor are continuously refilled with live ammunition rounds as they travel past the channel exit ends, and thus the upper run of the conveyor is completely filled with live ammunition which are handed off in a continuous stream to chuting 16 upon arrival at turnaround sprockets 36. As disclosed in the Garland et al. patent, the carriers in the upper run of the conveyor are tilted so that the live ammunition rounds thereon are clear of the sector cams as they revolve around into their sweeps past the channel exit ends.

While not shown, it will be appreciated that magazine entrance unit 18 is of the same construction as magazine exit unit 14, except that the sector cams 30 are mounted to the scoop wheel 29 in reverse end-to-end orientation from that seen in FIG. 2. The rotary scoop assembly thus functions as an offloading mechanism for the ammunition conveyor. The stream of spent shell casings returning from the gun via chuting 20 are loaded onto consecutive carriers of the conveyor as they swing clockwise about the turnaround sprockets and are scooped (offloaded) from the carriers by the cam extensions 42. The scooped rounds are guided to the entry ends of the channels by the sector cam ends **30*a* and 30*b* and forcibly inserted by the sector cam spiralled edges 30*d* during clockwise sweeps therepast. The scoop assembly and ammunition conveyor in the magazine entrance unit thus function as a distribution conveyor to distribute the incoming stream of spent shell casings to the channel open ends in repeating succession. The motions of the scoop wheel assemblies and conveyors in the magazine exit and entrance units are synchronized such that, while a live ammunition round is being scooped out of the exit end of each channel, a spent shell casing is being inserted into the entry ends thereof. Since the distances between the spiralled cam edges 30*d*** of the sector cams in the magazine entrance and exit units measured along each of the channels are equal and are a multiple of the case diameter, the channels are always completely filled with live ammunition rounds and spent shell casings in peripheral surface engagement. Thus, the forced insertions of spent shell casings into the entry ends advances the rows of live and spent rounds in the channels toward the exit ends to continuously present live ammunition rounds in scoop positions at the exit ends of the channels.

Reloading of the system may be accomplished by disconnecting chutings 16 and 20 at the gun and reconnecting them to a rearm system. Live ammunition rounds are fed into chuting 16 until spent shell casing stop coming out of chuting 20, at which point the entire system, i.e., chutings, magazine entrance and exit units, and the channels, are completely filled with live rounds. When the chutings are reconnected to the gun, the gun system is ready for action.

Returning to FIG. 1, it is seen that the generally circular configuration of the magazine entrance and exit units is ideally suited to turret mounted gun applications and to a highly dense packaging of channels 24 about the aligned axes 45 of the units, which may coincide with the elevation axis of the gun. As the angularly distributed array of channels radiate from the entrance and exit units, they undergo a gradual 90° twist about their longitudinal centerline, as indicated at 46, such that the axes of the rounds moving therethrough are rotated through a 90° angle. To increase magazine capacity, alternating channels 24*a* then undergo a pair of 180° turnarounds and a 90° turn to create a radially inwardly extending loop 48 adjacent each outboard side of the channel array. The 90° turns of these outboard loops are connected by an axially extending section 50. Alternating with channels 24*a* are channels 24*b* which are formed having a pair of radially inwardly extending loops 52 which are located inboardly of the outboard loops 48. It is thus seen that, by alternating channels 24*a* with channels 24*b*, the outboard and inboard loops assume circumferentially lapping or nested relations to conserve magazine space.

To facilitate negotiation of the rounds through the turnarounds in the channels, idler sprockets 54 are positioned thereat, as seen in FIG. 3. These star-shaped sprockets provide pockets 54*a* for receiving the rounds, either live or spent, and, in cooperation with the channel sides, guide the rounds through the 180° turns with minimal functional losses. While sprocket 54 is illustrated as having short rays 54*b*, so as not to interrupt round-to-round contact, they may be lengthened to physically separate the rounds and further increase efficiency. Idler sprockets may also be installed in the 90° channel turns.

Figure 4:
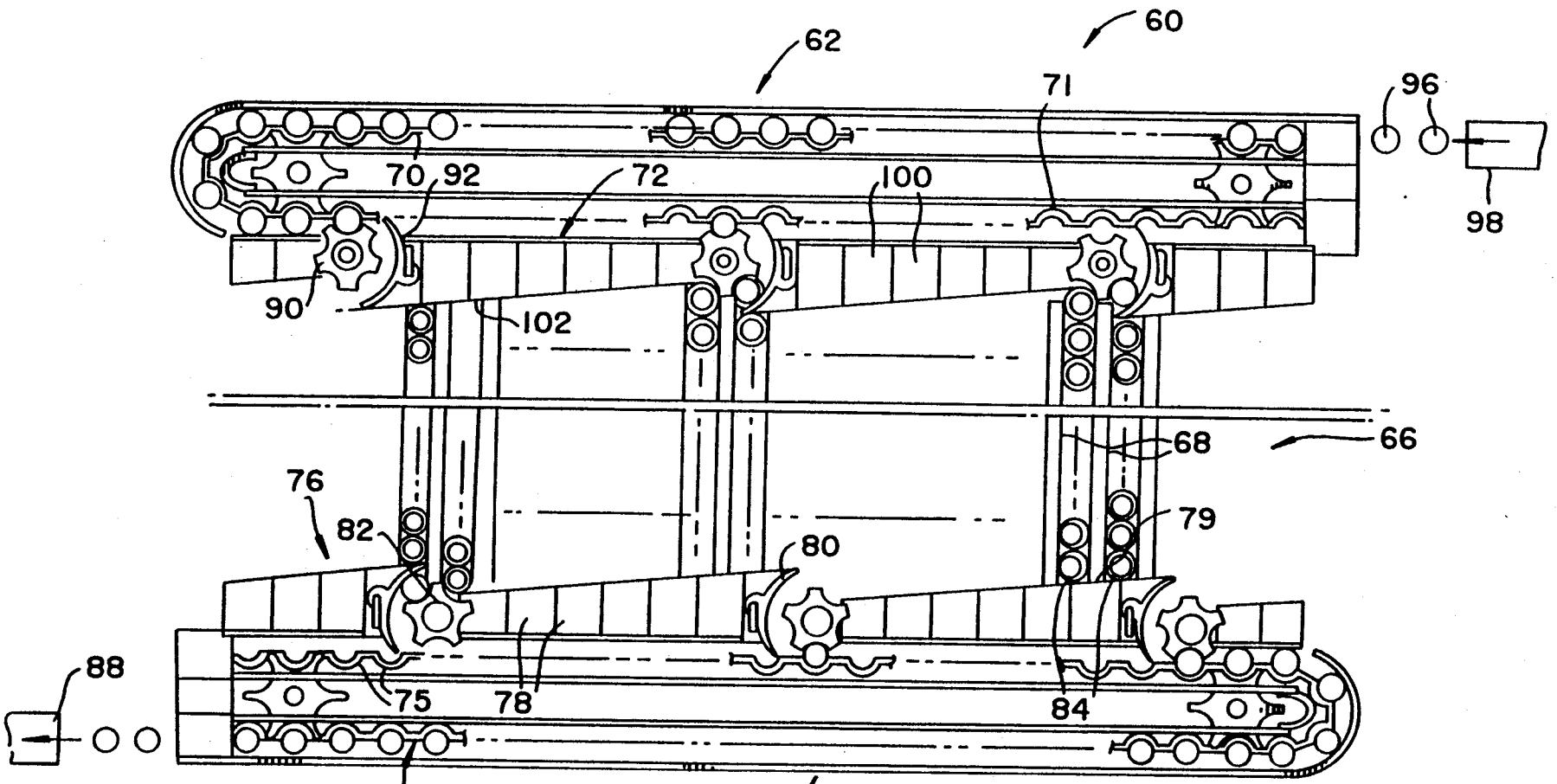
FIG. 4 is a front view of an ammunition handling system constructed in accordance with an alternative embodiment of the present invention.

For rapid-fire gun system which are not conducive to rotary scoop magazine entrance and exit units, a second embodiment of the invention, illustrated in FIG. 4, utilizes the linear scoop approach taught by the above-cited Ashley et al. patent, whose disclosure is specifically incorporated herein by reference. Thus, as seen in FIG. 4, an ammunition handling system, generally indicated at 60, includes a magazine entrance unit, generally indicated at 62 and a magazine exit unit, generally indicated at 64, serving a generally rectangular magazine, generally indicated at 66. The magazine includes a plurality of linear channels 68 arranged in closely spaced, parallel relation extending between magazine entrance unit 62 and magazine exit unit 64. The magazine entrance unit includes an endless ammunition conveyor, generally indicated at 70, and an offloading mechanism in the form of a linear scoop assembly, generally indicated at 72. Similarly, the magazine exit unit includes an endless ammunition conveyor, generally indicated at 74, and an onloading mechanism in the form of a linear scoop assembly, generally indicated at 76.

Considering magazine exit unit 64, linear scoop assembly 76 includes repeating linear arrays of cam segments 78, each terminated at its leading end with a scoop 80 and at its trailing end with sprocket 82. The cam segment arrays are connected end-to-end to provide an endless stripping assembly which, in combination with ammunition conveyor 74, functions as a stripping conveyor. The cam segments 78 of each array provide a continuous sloping cam edge 79 for controlling the positions of live ammunition rounds 84 at the exit ends of the channels. When the stripping assembly and ammunition conveyor 74 are driven at appropriate differential speeds with cam segment arrays and the upper ammunition conveyor run moving at a faster rate in the same direction from left to right as seen in FIG. 4, scoops 80 scoop out the leading live ammunition rounds from successive channel exits and, in concert with the sprocket 82 of the proceeding array, route them out onto consecutive carriers 75 of conveyor 74, all as disclosed in the Ashley et al. patent. Conveyor 74 is thus continuously being filled with live ammunition rounds which are delivered in its lower run seen in FIG. 4 as a continuous stream to gun-feeding chuting 88.

Magazine entrance unit 62 is essentially an inverted version of magazine exit unit 64, but with the interconnected arrays of cam segments 94 in reversed end-to-end relation. Thus leading end of each array is terminated with a sprocket 90 and the trailing end is terminated with a scoop 92.

With the stripping assembly driven in left to right linear sweeps past the entry ends of channels 68 and ammunition conveyor 70 driven such that its lower run also moves from left to right at a faster rate, spent shell casings 96 incoming from the gun via chuting 98 are conveyed in the upper run of the conveyor around to the cam segment arrays. The spent shell casings are scooped from the conveyor carriers 71 by scoops 92 and, in concert with the contiguous star sprockets 90, routed to the entry ends of the channels 68 in repeating succession. The edges of the cam segments 94 in each array provide a continuous cam edge 102 operating to forcibly insert the scooped spent shell casings into the channel entry ends and thus to push the rows of ammunition rounds in the channels toward the channel exit ends and magazine exit unit 64. It will be appreciated that, like the embodiment of FIGS. 1 and 2, the magazine entrance and exit units operate in synchronism such that, as a live ammunition round is being scooped out of the exit end of each channel in repeating succession, a spent shell casing being scooped into the entry end thereof. Again, the distances between cam edges 79 and 102 in the magazine exit and entrance units measured along each of the channels 68 are equal and are a multiple of the case diameter, and thus the live and spent rounds in each of the channels are in continuous peripheral surface contact. The rows of live and spent rounds are thus forced to propagate from the entry channel ends to the exit channel ends by the insertions of spent shell casings into the channel entry ends. Reloading of ammunition handling system 60 may be accomplished in the same manner described above in connection with ammunition handling system 10.

FIG. 5 illustrates a modification to ammunition handling system 60 of FIG. 4, wherein channels 68 of magazine 66 are in the form of replaceable, modular ammunition clips 104. When it is desired to reload magazine 106 in FIG. 5, magazine entrance unit 62 is lifted away after locking pins 106 are pulled to permit disassembly of upper and lower sections of vertical mounting posts 108. This clears the way for clips 104, which are filled mostly with spent shell casings, to be pulled upwardly, as illustrated at 104*a*, and removed from a mounting rock 110. Then, clips filled with live ammunition rounds are simply slid back into place in the rack to refill the magazine. As long as the chuting from the gun and the magazine entrance unit are filled with spent shell casings, and the chuting to the gun and magazine exit unit are filled with live ammunition rounds, the gun system can go back into action without missing a shot.

From the foregoing Detailed Description, it is seen that the present invention provides a double-end ammunition handling system wherein live ammunition rounds propagate through an ammunition storage magazine in a plurality of parallel streams from which they are merged to create a single continuous stream of live ammunition rounds for feeding a rapid fire gun. A continuous stream of spent shell casings coming from the gun are unmerged and distributed into the parallel streams within the magazine to motivate the propagation of live ammunition rounds therethrough. As a consequence, the necessity of a pusher mechanism, such as disclosed in the single-end ammunition handling systems of the Garland et al. and Ashley et al patents, to produce live ammunition round propagation through the magazine is avoided.

It is thus seen that the objectives of the present invention are efficiently attained, and, since certain changes may be made in the constructions set forth without departing from the scope of the present invention, it is intended that matters of detail be taken as illustrated and not in a limiting sense.

Having described the invention, what is claimed as new and desired to secure by Letters Patent is:

1. A double-ended ammunition handling system for a rapid-fire gun, said system comprising, in combination:

A. a magazine exit unit connected to the gun for delivering an outgoing stream of live ammunition rounds thereto;

B. a magazine entrance unit connected to the gun for accepting an incoming stream of spent shell casings therefrom;

C. a magazine including a plurality of coextensive channels having entry ends successively arrayed adjacent said magazine entrance unit and exit ends successively arrayed adjacent said magazine exit unit, all said channels being completely filled with said live ammunition rounds and said spent shell casings, wherein each of said rounds and casings are in peripheral surface engagement;

D. a first means in said magazine entrance unit for forcibly inserting said spent shell casings from said incoming stream into said entry ends of said channels in repeating succession to advance said spent shell casings and said live ammunition rounds in said channels toward said exit ends of said magazine to continuously present said live ammunition rounds to said magazine exit unit; and E. second means in said magazine exit unit for picking said live ammunition rounds out of said exit ends of said channels in corresponding repeating succession to create said outgoing stream.

2. The system defined in claim 1, wherein said first and second means operate in synchronism such that a spent shell casing is inserted into said entry end of each said channel as a live ammunition round is picked from said exit end thereof.

3. The system defined in claim 2, wherein said first means includes a first conveyor on which spent shell casings of said incoming stream are loaded onto successive first conveyor carriers and an offloading mechanism for unloading spent shell casings from said first conveyor into said successive entry ends of said channels during coordinated sweeps of said offloading mechanism and said conveyor carriers past said channel entry ends, and said second means includes a second conveyor and an onloading mechanism operating to load live ammunition rounds onto successive second conveyor carriers from said successive exit ends of said channels for merger into said outgoing stream during coordinated sweeps of said onloading mechanism and said second conveyor carriers past said channel exit ends.

4. The system defined in claim 3, wherein said offloading mechanism and said first conveyor are implemented to execute repeating linear sweeps past said channel entry ends, and said onloading mechanism and said second conveyor are implemented to execute corresponding, repeating linear sweeps past said channel exit ends.

5. The system defined in claim 3, wherein said offloading mechanism and said first conveyor are implemented to execute repeating arcuate sweeps past said channel entry ends, and said onloading mechanism and said second conveyor are implemented to execute corresponding, repeating arcuate sweeps past said channel exit ends.

6. The system defined in claim 5, wherein said channels are arranged in a tightly packed, angularly distributed array between said magazine entrance and exit units.

7. The system defined in claim 1, wherein each said channel includes a first section extending from said entry end radially outward from said magazine entrance unit, a second section extending from said exit end radially outward from said magazine exit unit, and a third section interconnecting said first and second sections, said first and second sections being formed having 90° twists, and said third sections being formed having at least one radially inwardly extending loop.

8. The system defined in claim 7, wherein said third sections of alternating said channels are respectively formed having alternating inboard and outboard pairs of said loops assuming lapped relations in said array.

9. The system defined in claim 8, wherein idler sprockets are incorporated in said third channel sections to facilitate negotiations of the live ammunition rounds and spent shell casings through turnarounds of said loops.

10. The system defined in claim 1, wherein said channels are in the form of replaceable modular ammunition clips.

11. A double-ended ammunition handling system for feeding a rapid-fire gun, said system comprising, in combination;

A. a magazine exit unit for delivering an outgoing stream of live ammunition rounds to the gun;

B. a magazine entrance unit for accepting an incoming stream of spent shell casings from the gun;

C. a magazine having a plurality of coextensive channels having entry ends presented in a successive array to said magazine entrance unit and exit ends presented in a successive array to said magazine exit unit, all said channels being completely filled with said live ammunition rounds and said spent shell casings, wherein each of said rounds and casings are in peripheral surface engagement;

D. means in said magazine entrance unit including a first conveyor on which said spent shell casings of said incoming stream are loaded and a first scoop assembly moving in coordination to divert spent shell casings from said first conveyor to said channel entry ends in repeating succession, said scoop assembly including cam means for forcibly inserting said diverted spent shell casings into said channel open ends to advance said spent shell casings and said live ammunition rounds in said channels toward said exit ends of said magazine to continuously present said live ammunition rounds to said magazine exit unit; and E. means in said magazine exit unit including a second conveyor and a second scoop assembly for picking said live ammunition rounds from said exit ends of said channels in corresponding repeating succession and loading said picked live ammunition rounds onto said second conveyor to make up said outgoing stream.

12. The system defined in claim 11, wherein said first and second scoop assemblies operate in synchronism such that a spent shell casing is inserted into said entry end of each said channel as a live ammunition round is picked from said exit end thereof.

13. The system defined in claim 12, wherein said first and second scoop assemblies each comprise a rotating scoop wheel, an annular series of sector cams mounted to said scoop wheel, and separate scoops terminating corresponding ends of said sector cams, said sector cams of said first scoop assembly providing said spent shell casing insertion cam means, and said sector cams of said second scoop assembly controlling the positions of live ammunition rounds in said channel exit ends.

14. The system defined in claim 12, wherein said first and second scoop assemblies each comprise a plural series of cam segments carried in end-to-end relation for movement in an endless loop, a separate scoop terminating one end of each said cam segment series, and a sprocket terminating the other end of each said cam segment series, said cam segments series of said first scoop assembly providing said spent shell casing insertion cam means, and said cam segment series of said second scoop assembly controlling the positions of the live ammunition rounds in said channel exit ends.

15. The system defined in claim 12, wherein said channels are in the form of replaceable, modular ammunition clips.

16. The system defined in claim 11, wherein said channels are arranged in a tightly packed, angularly distributed array between said magazine entrance and exit units.

17. The system defined in claim 11, wherein each said channel includes a first section extending from said entry end radially outward from said magazine entrance unit, a second section extending from said exit end radially outward from said magazine exit unit, and a third section interconnecting said first and second sections, said first and second sections being formed having 90° twists, and said third sections being formed having at least one radially inwardly extending loop.

18. The system defined in claim 11, wherein the live ammunition rounds are case telescoped rounds.

* * * * *